US009945371B2

(12) United States Patent
De Regt

(10) Patent No.: US 9,945,371 B2
(45) Date of Patent: Apr. 17, 2018

(54) VENTING BELLOW PUMP SYSTEM

(71) Applicant: MeadWestvaco Calmar Netherlands B.V., Richmond, VA (US)

(72) Inventor: Jeroen D. De Regt, Oss (NL)

(73) Assignee: SILGAN DISPENSING SYSTEMS NETHERLANDS B.V., Waalwijk (NL)

( * ) Notice: Subject to any disclaimer, the term of this patent is extended or adjusted under 35 U.S.C. 154(b) by 486 days.

(21) Appl. No.: 14/385,530

(22) PCT Filed: Mar. 15, 2013

(86) PCT No.: PCT/EP2013/055444
§ 371 (c)(1),
(2) Date: Sep. 16, 2014

(87) PCT Pub. No.: WO2013/135883
PCT Pub. Date: Sep. 19, 2013

(65) Prior Publication Data

US 2015/0071801 A1 Mar. 12, 2015

Related U.S. Application Data

(60) Provisional application No. 61/611,821, filed on Mar. 16, 2012.

(51) Int. Cl.
*F04B 45/02* (2006.01)
*B05B 11/00* (2006.01)
*F04B 53/10* (2006.01)

(52) U.S. Cl.
CPC ..... *F04B 45/02* (2013.01); *B05B 11/0016* (2013.01); *B05B 11/3035* (2013.01); *F04B 53/10* (2013.01)

(58) Field of Classification Search
CPC ..... F04B 45/02; F04B 53/10; B05B 11/0016; B05B 11/3035
USPC ..... 417/480
See application file for complete search history.

(56) References Cited

U.S. PATENT DOCUMENTS 5,238,156 A * 8/1993 Andris ..... B05B 11/007 222/207
5,476,195 A * 12/1995 Oder ..... B05B 11/0064 222/207
5,518,147 A * 5/1996 Peterson ..... B05B 11/3035 222/153.07

(Continued)

FOREIGN PATENT DOCUMENTS

EP 0720951 A1 7/1996
WO WO91/03321 3/1991

(Continued)

OTHER PUBLICATIONS

International Search Report from PCT/EP2013/055444, dated Jun. 10, 2013.

*Primary Examiner* — Essama Omgba
*Assistant Examiner* — Stephen Mick
(74) *Attorney, Agent, or Firm* — Barlow, Josephs & Holmes, Ltd.

(57) ABSTRACT

A simplified pump system including a bellow (310) having a suction valve (312), a stem (320), a fluid lock (330), and a tube retainer (380) having a vent element wherein the product flow into and out of a pump chamber formed by the bellow (310) and stem (320) is controlled by the suction valve (312) and fluid lock (330).

1 Claim, 8 Drawing Sheets

(56) References Cited

U.S. PATENT DOCUMENTS

| | | | | |
|---|---|---|---|---|
| 6,805,267 | B2 * | 10/2004 | Bougamont | B05B 11/0064 222/207 |
| 6,910,603 | B2 * | 6/2005 | Smith | B05B 11/0029 222/153.13 |
| 8,360,284 | B2 * | 1/2013 | Carta | B05B 11/0016 222/207 |
| 2009/0110576 | A1 * | 4/2009 | Brouwer | B05B 11/3033 417/472 |

FOREIGN PATENT DOCUMENTS

| | | |
|---|---|---|
| WO | WO95/01226 | 1/1995 |
| WO | WO2006/031110 | 3/2006 |
| WO | WO2009/047827 | 4/2009 |

* cited by examiner

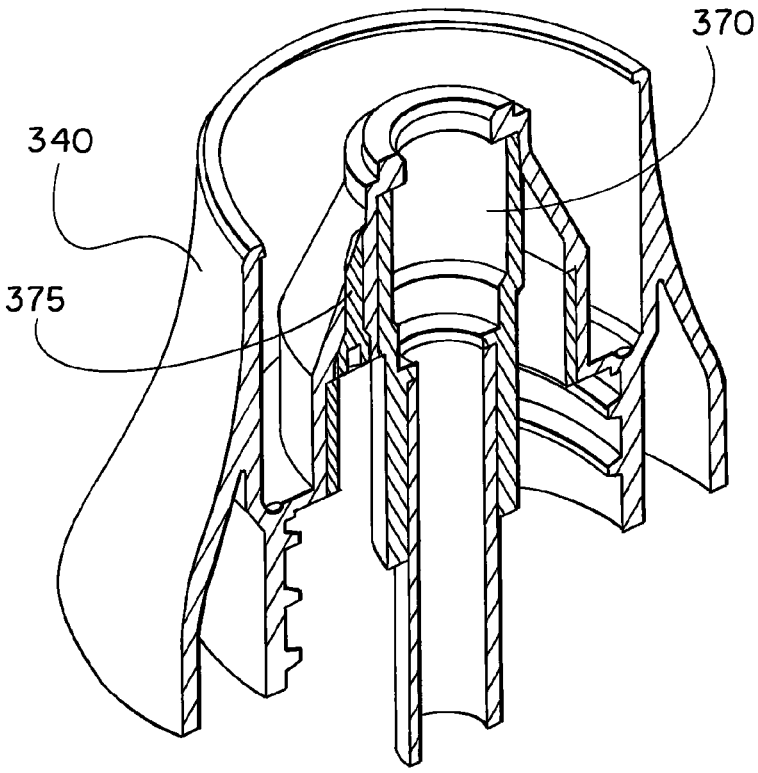
Fig. 5
Fig. 6
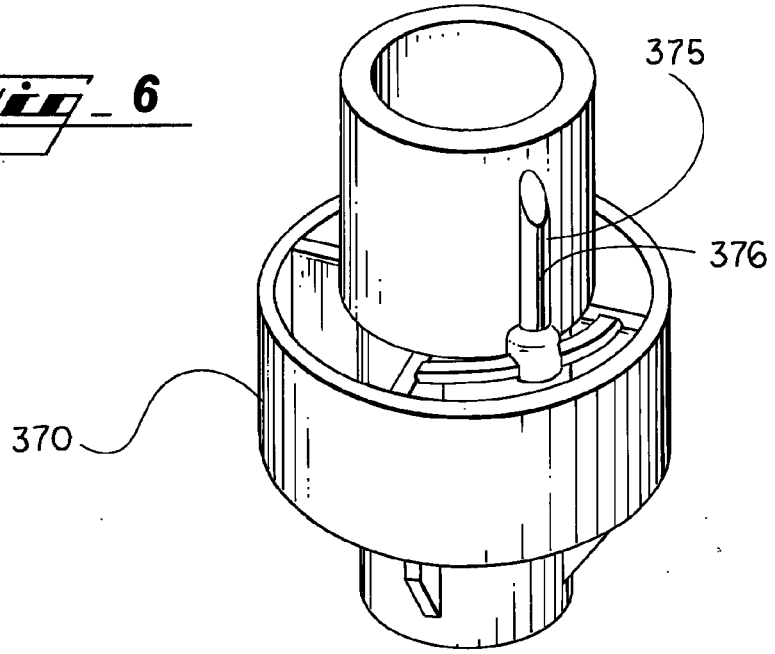

VENTING BELLOW PUMP SYSTEM

BACKGROUND OF THE INVENTION

Field of the Invention

The present invention relates to pump devices and in particular to bellow-type pumps for dispensing fluids or other pasty products.

State of the Art

Pumps and pump devices are known. In addition, pumps using bellows systems as springs and pistons are known. For example, U.S. Pat. No. 7,793,803, which is incorporated by reference herein in its entirety, discloses a bellow-type pump and pump system which is known.

Another type of pump is disclosed in PCT Application PCT/US11/066423, which is incorporated herein by reference in its entirety.

While various bellow-type pump systems are known, the use of bellows for new delivery requirements and improvements in such pumps are desirable.

BRIEF SUMMARY OF THE INVENTION

According to various embodiments of the invention, a pump system may include a bellow, a stem, a fluid lock, a base, a pump head and a tube retainer attached together to form a pump. In some embodiments, a portion of the base and tube retainer may act together to form a vent to allow a container attached to the pump system to vent.

In some embodiments of the invention, a tube retainer may include one or more thin walled portions which may seal against a base of the pump system. Upon actuation of a pump and withdrawal of a product from within a container attached to the pump system, a pressure difference between the interior of the container and an exterior thereof may be sufficient to allow a flexing of the one or more thin walled portions such that they may unseat from the base and allow the container to vent.

According to other embodiments of the invention, a tube retainer may include one or more valve posts which may fit in openings in a base and seal against the base. The one or more valve posts may be moved and unseated from the base upon actuation of a bellow and contact between the bellow and the one or more valve posts.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

FIG. 5 illustrates a cross-sectional view of a portion of a pump system according to various embodiments of the invention;

FIG. 6 illustrates a tube retainer according to various embodiments of the invention;

DETAILED DESCRIPTION OF THE INVENTION

According to embodiments of the invention, a pump system may include a bellow, a stem, and a fluid lock acting together to form a pump for moving a product, such as a liquid or pasty material, from a container to a location outside of the container for use. In some embodiments of the invention, a bellow and stem may form a bellow chamber for holding a product and the stem may seal against the bellow until such time that the pump system is actuated when the seal between the bellow and stem may be broken, allowing product contained in the bellow chamber to flow out of the bellow chamber. In certain embodiments of the invention, the fluid lock or seal may be fitted with or attached to the stem such that as the stem moves, the fluid lock is seated or unseated, thereby blocking fluid flow into a bellow chamber or allowing fluid to flow therethrough when a vacuum or suction force is applied to a fluid in a container. In addition, various embodiments of the invention include one or more features to allow venting of a container attached to the pump system.

Figure 1:
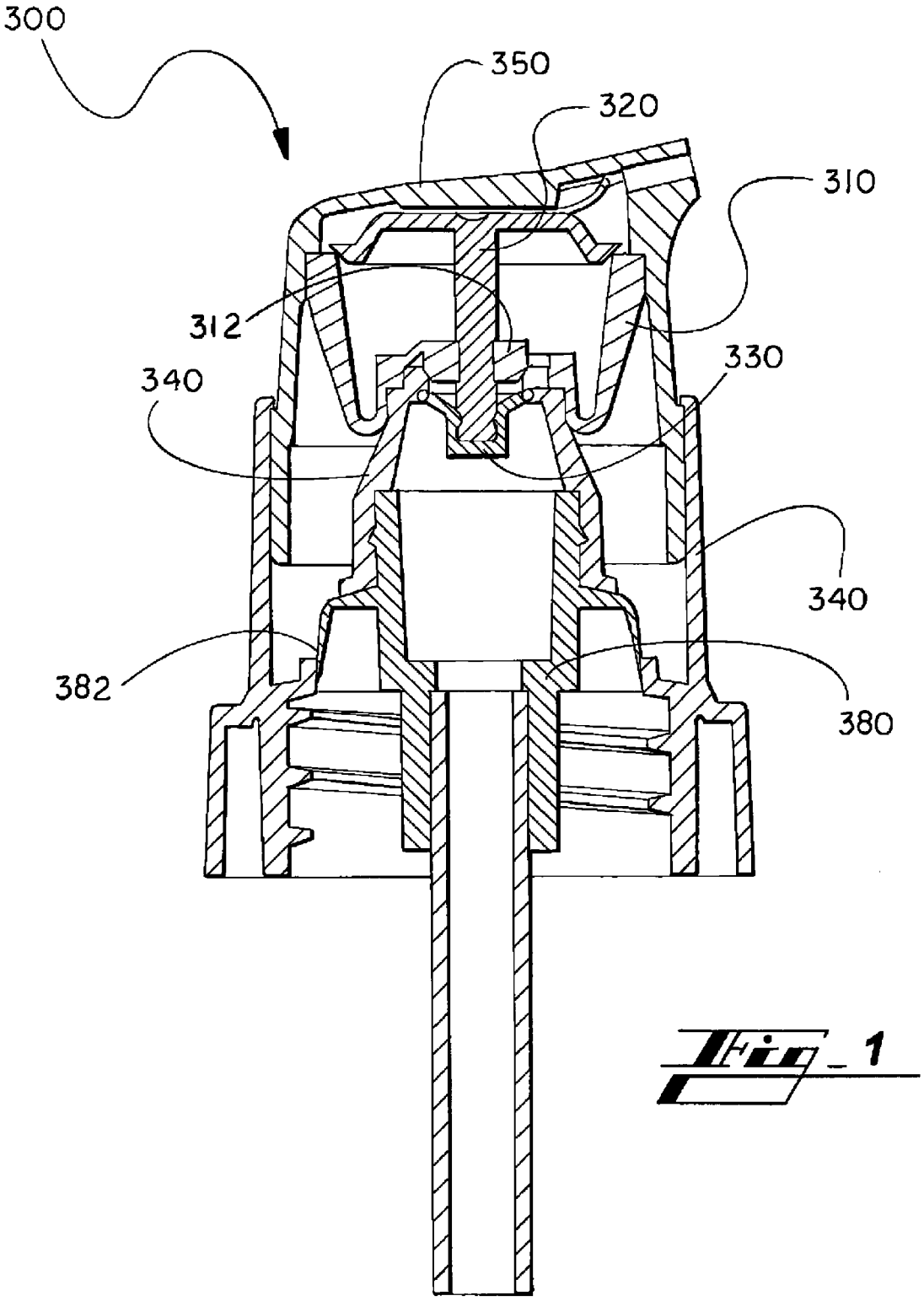
FIG. 1 illustrates a cross-sectional view of a pump system according to various embodiments of the invention.
Figure 2:
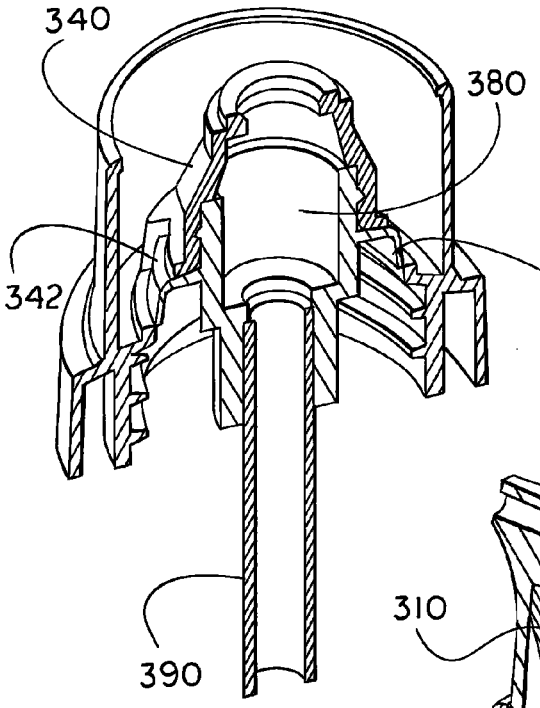
FIG. 2 illustrates a cross-sectional view of a portion of a pump system according to various embodiments of the invention.
Figure 3:
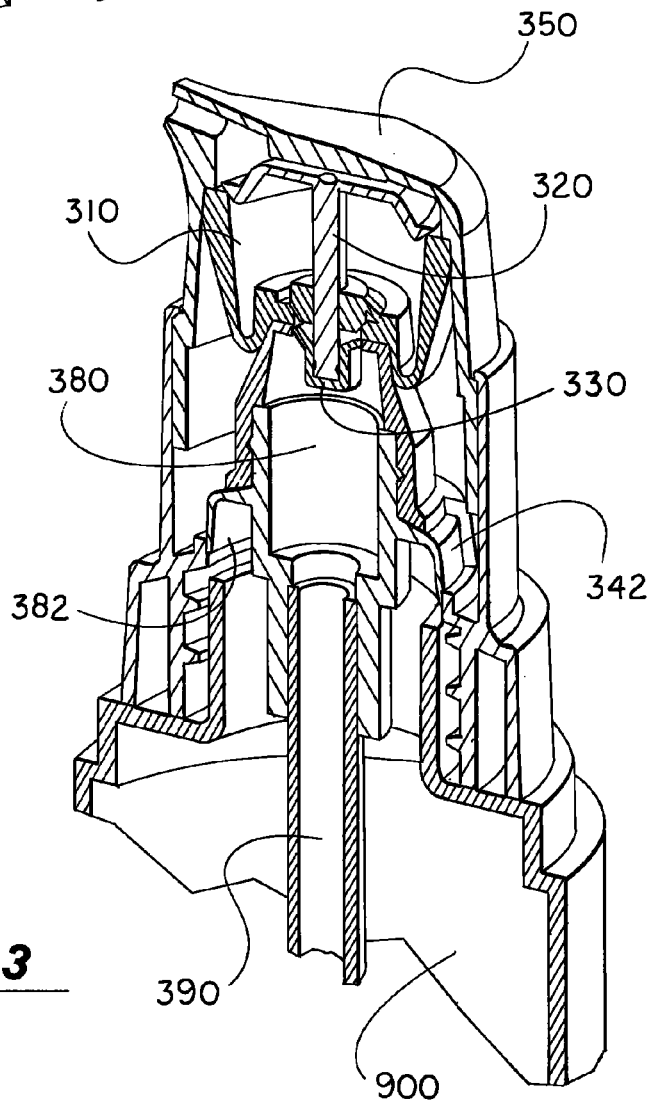
FIG. 3 illustrates a cross-sectional view of a pump system according to various embodiments of the invention.
Figure 4:
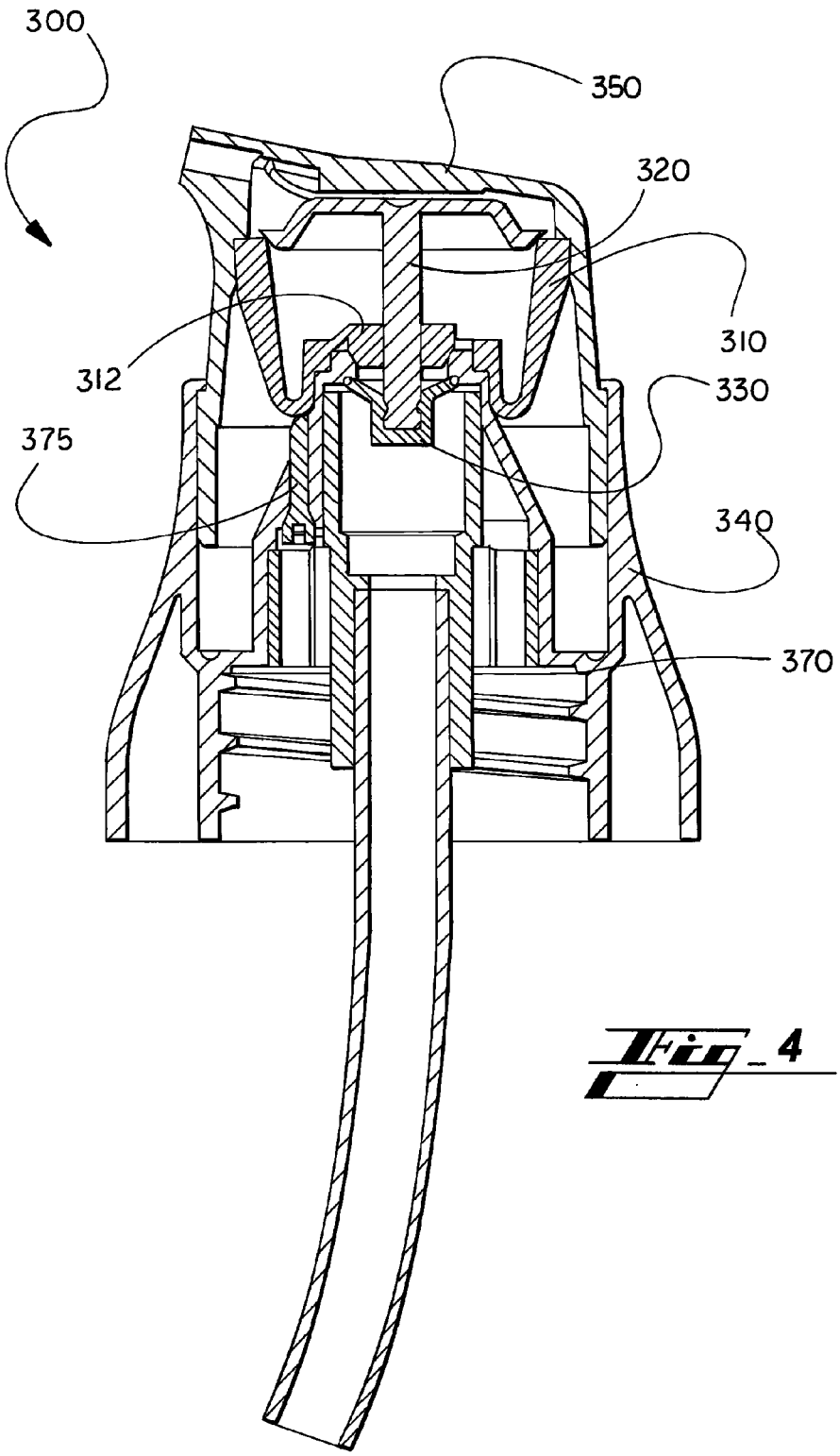
FIG. 4 illustrates a cross-sectional view of a pump system according to various embodiments of the invention.
Figure 7:
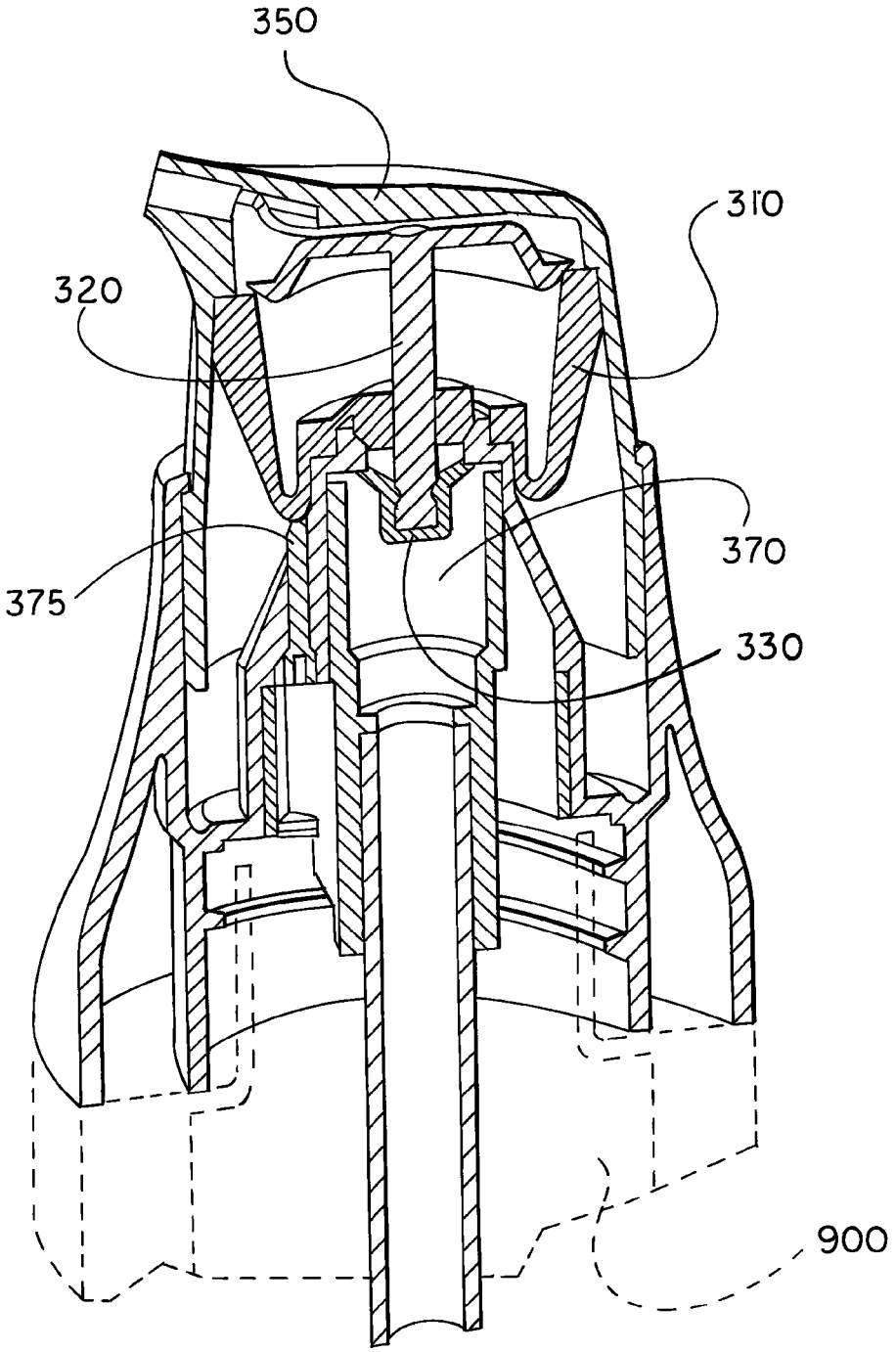
FIG. 7 illustrates a cross-sectional view of a pump system according to various embodiments of the invention.
Figure 8:
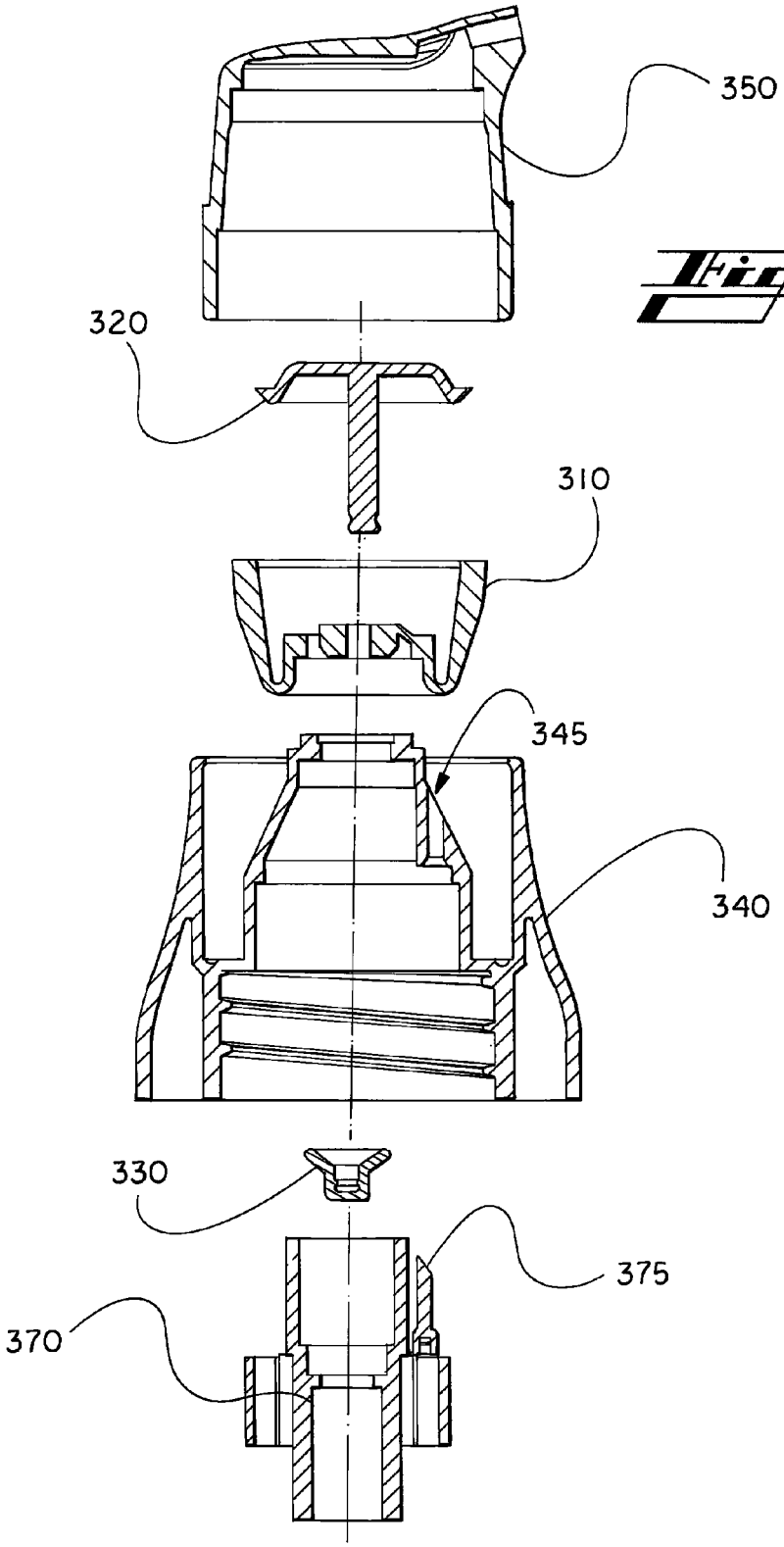
FIG. 8 illustrates a blown apart, cross-sectional view of a pump system according to various embodiments of the invention.
Figure 9:
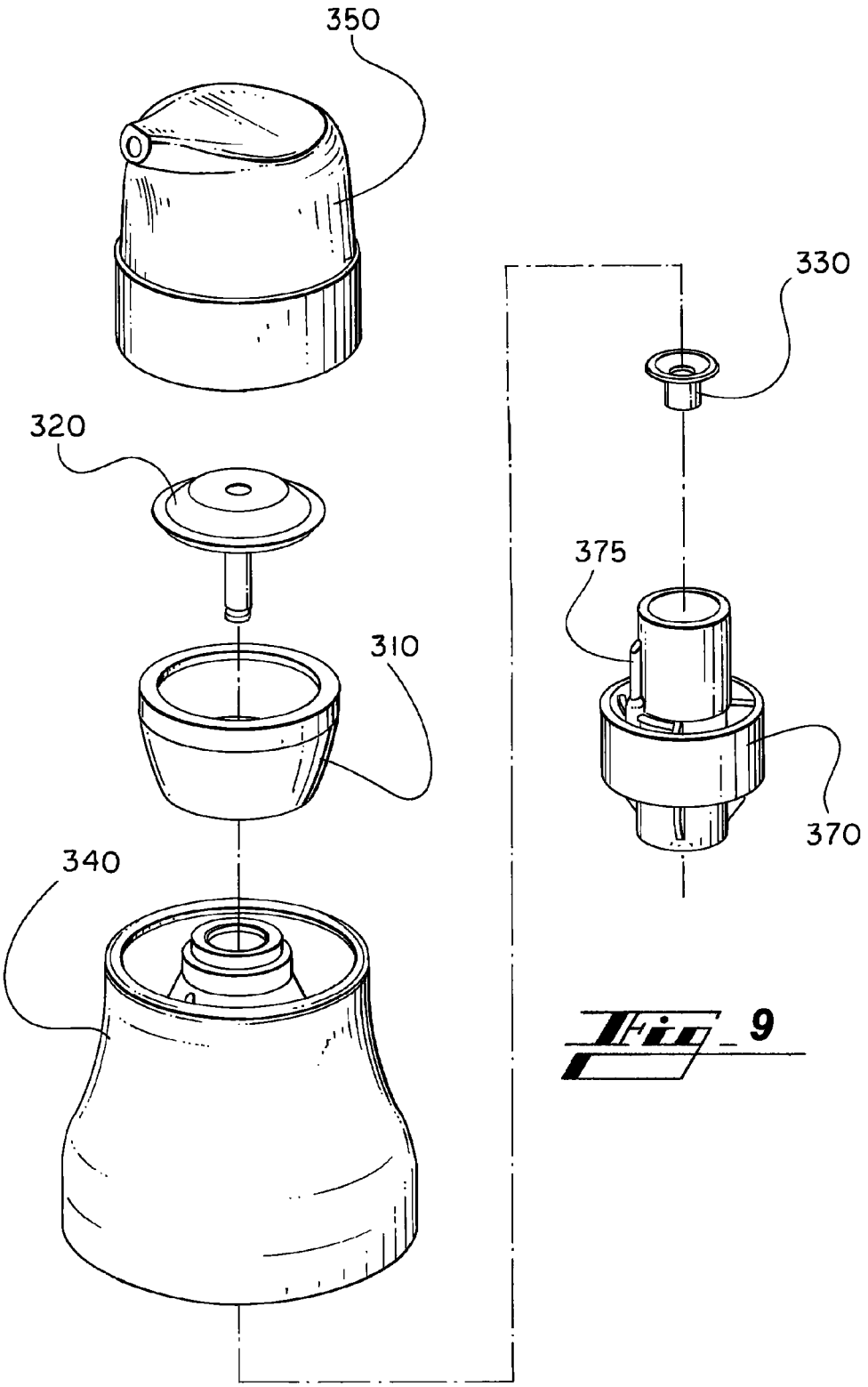
FIG. 9 illustrates a blown apart view of a pump system according to various embodiments of the invention.

According to various embodiments of the invention, a pump system 300 may include a bellow 310, a stem 320, a fluid lock 330, a base 340, a pump head 350 and a tube retainer 380 as illustrated in FIGS. 1 through 3.

According to other embodiments of the invention, a pump system 300 may include a bellow 310, a stem 320, a fluid lock 330, a base 340, a pump head 350, and a tube retainer 370 including one or more venting valves 375 as illustrated in FIGS. 4 through 11.

According to various embodiments of the invention, a bellow 310 may be made of a silicon material. In other embodiments, a bellow 310 may be made of any desirable material and such material may be selected to be compatible with a product which will be pumped through the bellow 310 during use of the pump system 300. Some other materials that may be used to construct, mold, or otherwise form a bellow 310 include TPU, TPE, or other elastomeric polymer materials.

A bellow 310 according to embodiments of the invention may also take on varying shapes and sizes. The size of a bellow 310 may be adjusted to accommodate an amount of product which is desired for dispensing from the pump system 300. In addition, the bellow 310 may be shaped or constructed to provide certain actuating forces and return forces based on the thickness of the walls, shapes of the walls, and other characteristics of the bellow 310.

According to various embodiments of the invention, a bellow 310 may include a suction valve 312 which may move during the actuation stroke of a pump system 300 and during the return stroke following actuation of the pump system 300. The suction valve 312 may be attached to the body of the bellow 310 by legs, arms, or other configurations which include gaps between the suction valve 312 and the remainder of the bellow 310 such that product may pass into the bellow 310 when the pump system 300 is in use.

Bellows 310 according to embodiments of the invention may also include an upper lip which contacts a pump head 350 any may be moved by the pump head 350 during actuation of a pump system 300. In addition, portions of the upper lip of a bellow 310 may interact with portions of the stem 320 to form a valve or seal a compartment or pump chamber between an interior of a bellow 310 and the stem 320.

A stem 320 according to various embodiments of the invention may be configured in any desired shape. A stem 320 may also be made of any desirable material. For example, a stem 320 may be made of a moldable plastic or resin such as polypropylene or other material.

According to embodiments of the invention, a stem 320 may include a top portion configured to interact with an upper portion or upper lip of a bellow 310, a neck extending from the top portion to an end portion which may be configured to attach to or mate with a fluid lock 330. The top portion may be configured in any desired shape to provide the characteristics desired for a pump system 300. A portion of the neck may pass through a hole in a suction valve 312 of a bellow 310 and the end portion may extend outside the bellow 310. The end portion of the stem 320 may be connected to, mated with, or otherwise attached to a fluid lock 330 as illustrated in the various Figures.

A fluid lock 330 according to various embodiments of the invention may be configured in any desired shape and made of any desired material. In some embodiments, a fluid lock 330 may be made of a moldable polymer or resin.

A fluid lock 330 may attach to an end portion of a stem 320 which projects through a suction valve 312 of a bellow 310. In some embodiments of the invention, a fluid lock 330 is attached to an end portion of a stem 320 which passes through a portion of a base 340. The attachment of a fluid lock 330 to a stem 320 may serve to hold a bellow 310 on a base 340 for assembly of a pump system 300. When assembled with a stem 320, a fluid lock 330 may seal against a portion of the base 340, forming a seal and closing access to an opening in the base such that liquid, fluid, or other product may not pass by the fluid lock 330 and into an interior space of the bellow 310.

While a fluid lock 330 is shown with various embodiments of the invention, a pump system 300 having no fluid lock 330 may also be used. In such embodiments, an alternative means for stopping fluid or product flow into the bellow 310 upon application of a force to a container may be needed. For example, an additional valve could be molded with or integrated with the base 340.

A base 340 according to various embodiments of the invention may be configured in any desirable shape or size. For example, the base 340 illustrated in FIG. 1 differs from the base 340 illustrated in FIG. 4. A base 340 may include an opening in the base 340 through which product—such as a liquid or fluid—may pass during operation of the pump system 300. According to some embodiments of the invention, a suction valve 312 of a bellow 310 may seat in an opening, forming a seal therewith during actuation of a pump system 300 such that a fluid or product may not pass into an interior space of the bellow 310 during actuation. Following actuation, the suction valve 312 may unseat from the opening in the base 340 and allow fluid or product to enter an interior space of the bellow 310 until a fluid lock 330 engages and seals with the base 340, preventing additional fluid or product flow.

According to various embodiments of the invention, a pump system 300 may include one or more venting features. In some embodiments of the invention, a base 340 may be configured as illustrated in FIGS. 1 through 3. As illustrated, a base 340 may include a fitment into which a tube retainer 380 may be seated or fitted. According to embodiments of the invention, a tube retainer 380 may include one or more thin walled portions 382 or seal portions which may seal against a portion of the base 340 as illustrated in FIG. 1. The base 340 may also include one or more openings 342 adjacent to the one or more thin walled portions 382 as illustrated in FIGS. 2 and 3. As shown, the one or more thin walled portions 382 form a valve or gate between an interior portion of a container 900 and an exterior thereof when the pump system 300 is attached to a container 900. The one or more openings 342 in the base 340 may allow atmospheric pressure to act on the one or more thin walled portions 382 such that when a pressure difference between an interior of a container 900 and an exterior thereof is different, the atmospheric pressure may unseat or unseal the one or more thin walled portions 382 from the base 340, allowing the container 900 to vent.

According to various embodiments of the invention, a tube retainer 380 may be made of a flexible material such that the one or more thin walled portions 382 may flex as desired to allow a container to vent.

According to other embodiments of the invention, a pump system 300 may include a tube retainer 370 having one or more integral valve posts 375 as illustrated in FIGS. 5 through 10. In such embodiments, a base 340 may include one or more valve openings 345 into which one or more integral valve posts 375 may fit or seat. The one or more valve posts 375 may include one or more grooves to facilitate bending or deformation of the valve post 375. In addition, a valve post 375 may include a ball-shaped or rounded vent seal 378 which may press against a conical opening 348 in the base 340, thereby sealing an interior of a container 900 attached to a pump system 300 from an exterior thereof.

Figure 10:
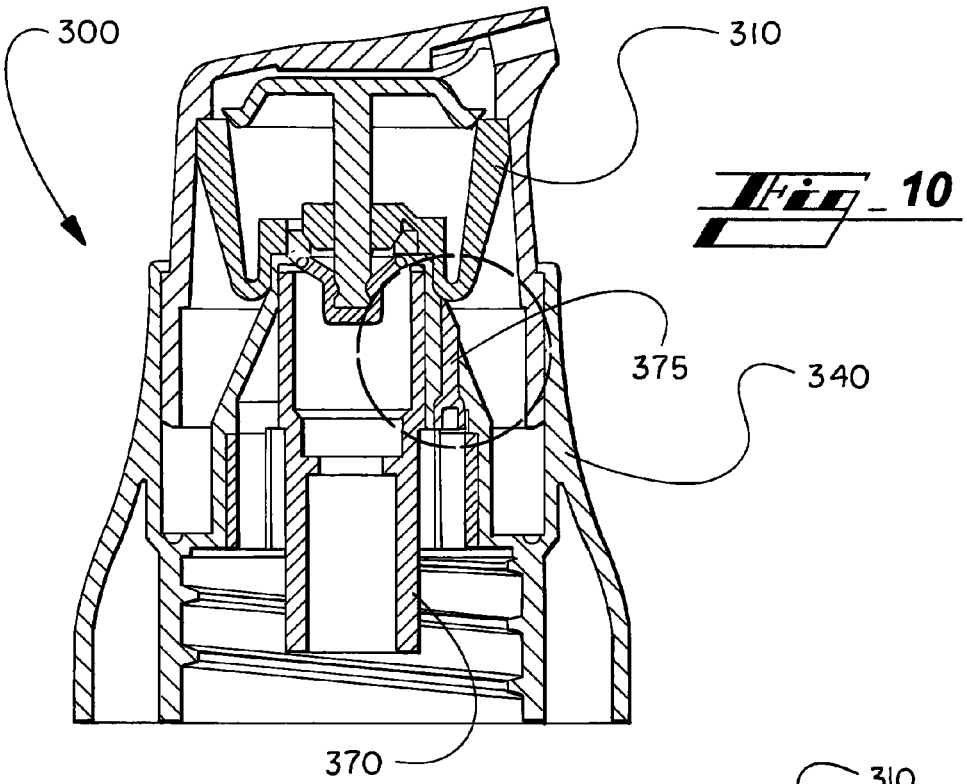
FIG. 10 illustrates a cross-sectional view of a pump system according to various embodiments of the invention.
Figure 11:
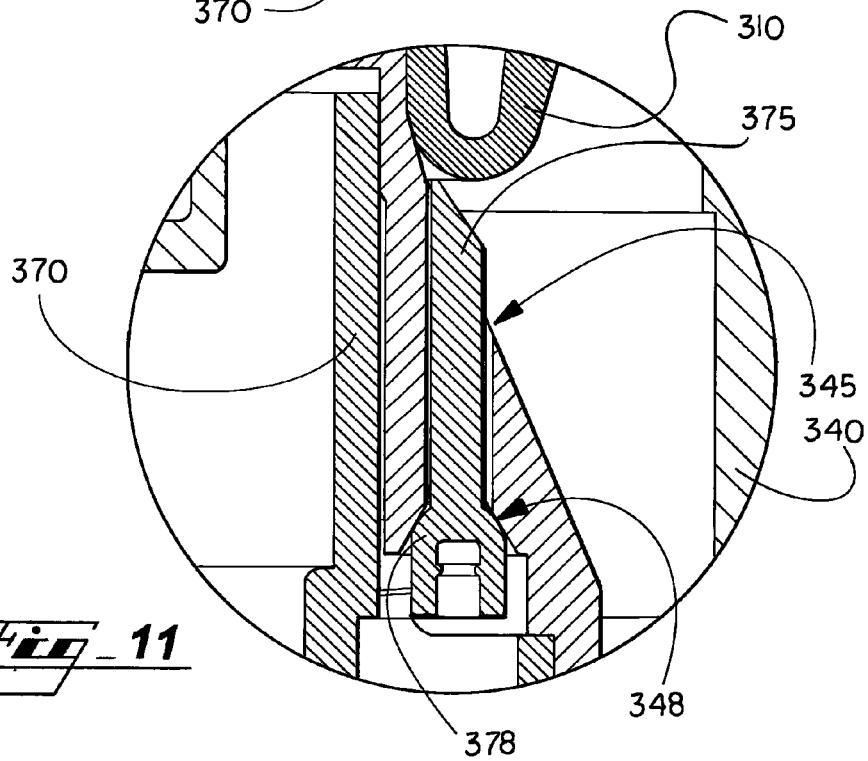
FIG. 11 illustrates a cross-sectional, close-up view of a portion of FIG. 10.

For example, a close-up view of a valve post 375 seated in a valve opening 345 according to various embodiments of the invention is illustrated in FIGS. 10 and 11. As illustrated in FIG. 11, a valve post 375 may include a vent seal 378 seated against a conical opening 348 in the base 340. As bellow 310 is actuated and it is pushed down over an end portion of the valve post 375, the bellow 310 may cause the valve post 375 to move, which in turn may unseat the vent seal 378 portion of the valve post 375 from the conical opening 348. The unseating of the vent seal 378 opens a vent path from an interior of a container 900 attached to the pump system 300 to an exterior thereof, allowing the container 900 to vent.

According to various embodiments of the invention, any of the configurations illustrated in FIGS. 1 through 11 may be used to form a vent path for a pump system 300 according to embodiments of the invention.

A base 340 according to various embodiments of the invention may also include additional features for securing a pump system 300 to a container. For example, a base 340 may include threads for attaching the base, and pump system 300, to a container having a threaded closure. A base 340 may also include lugs or bayonet closure mechanisms and features to secure the base 340, and the pump system 300, to a container. Other snap-fitment, plug-fitment, threaded closures, welds or other attachment systems may be incorporated with a base 340 to allow a pump system 300 to be attached to a container 900.

A pump system 300 according to embodiments of the invention may be configured to attach to any desired container. For example, a pump system 300 according to embodiments of the invention may be attached to a bottle using a conventional screw-type fitment system. In other embodiments, a base 340 may be welded or otherwise attached to an opening in the tube. Various embodiments of the invention may be attached to other conventional containers such as bottles, bags, tubes, or other containers from which a product may be drawn or pumped. In addition, attachment of a pump system 300 to a container may be by any conventional methods.

According to some embodiments of the invention, one or more locking features may be added to a pump system 300 to allow a user to lock the pump system 300 and prevent or allow actuation of the pump system 300 as desired.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump system, comprising:

a base comprising an opening therein;

a bellow resting on the base;

a stem resting on the bellow and extending through the opening in the base;

a fluid lock attached to a stem portion extending through the opening in the base; and a tube retainer seated in the base and comprising at least one thin walled portion adjacent the opening in the base, wherein contact between the at least one thin walled portion and the base forms a valve that allows the pump system to vent in response to a pressure difference by unseating the at least one thin walled portion from the base.

* * * * *